US011186101B2

(12) United States Patent
Yoshida et al.

(10) Patent No.: US 11,186,101 B2
(45) Date of Patent: Nov. 30, 2021

(54) BASE MATERIAL PROCESSING APPARATUS AND DETECTION METHOD

(71) Applicant: SCREEN HOLDINGS CO., LTD., Kyoto (JP)

(72) Inventors: Mitsuhiro Yoshida, Kyoto (JP); Yuichi Hanada, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/929,987

(22) Filed: Jul. 15, 2020

(65) Prior Publication Data

US 2020/0346470 A1 Nov. 5, 2020

Related U.S. Application Data

(62) Division of application No. 16/107,417, filed on Aug. 21, 2018, now Pat. No. 10,752,025.

(30) Foreign Application Priority Data

Sep. 25, 2017 (JP) ..... JP2017-183299

(51) Int. Cl.
*B41J 11/00* (2006.01)
*B65H 23/02* (2006.01)
(Continued)

(52) U.S. Cl.
CPC ..... *B41J 11/0095* (2013.01); *B41J 2/2146* (2013.01); *B41J 11/008* (2013.01);
(Continued)

(58) Field of Classification Search
CPC ... B41J 11/008; B41J 11/0095; B41J 11/0025; B41J 15/04; B41J 15/24; B41J 2/2146;
(Continued)

(56) References Cited

U.S. PATENT DOCUMENTS 8,588,632 B2 11/2013 Ohshima et al.
2009/0016785 A1 1/2009 Haan et al.
(Continued)

FOREIGN PATENT DOCUMENTS

CN 102310634 A 1/2012
CN 102681378 A 9/2012
(Continued)

OTHER PUBLICATIONS

L. Mingying, "Printing and Design, Elasticity of Paper", Northeastern University Press, Dec. 31, 2016, p. 121, with partial English translation.

(Continued)

*Primary Examiner* — Jannelle M Lebron
(74) *Attorney, Agent, or Firm* — McDermott Will & Emery LLP

(57) ABSTRACT

A base material processing apparatus includes a first edge sensor, a second edge sensor, and a displacement amount calculation part. The first edge sensor acquires a first detection result (R1) by detecting the position of an edge of a base material in the width direction at a first detection position. The second edge sensor acquires a second detection result (R2) by detecting the position of the edge of the base material in the width direction at a second detection position. The displacement amount calculation part calculates the amount of displacement in the position of the base material in the transport direction on the basis of the first detection result (R1) and the second detection result (R2). Accordingly, the amount of displacement in the position of the base material in the transport direction can be detected without depending on images such as register marks.

16 Claims, 7 Drawing Sheets

(51) Int. Cl.
*B41J 2/21* (2006.01)
*B41J 15/04* (2006.01)
*B41J 15/24* (2006.01)

(52) U.S. Cl.
CPC ..... *B41J 11/0025* (2013.01); *B41J 15/04* (2013.01); *B41J 15/24* (2013.01); *B65H 23/0216* (2013.01); *B65H 2801/12* (2013.01)

(58) Field of Classification Search
CPC . B41J 11/009; B65H 23/0216; B65H 2801/12
See application file for complete search history.

(56) References Cited

U.S. PATENT DOCUMENTS

| | | | |
|---|---|---|---|
| 2011/0316925 | A1 | 12/2011 | Saita |
| 2012/0237231 | A1 | 9/2012 | Ohshima et al. |
| 2016/0075155 | A1 | 3/2016 | Fukui et al. |
| 2016/0121602 | A1 | 5/2016 | Nagasu et al. |
| 2016/0121627 | A1 | 5/2016 | Yoshida et al. |

FOREIGN PATENT DOCUMENTS

| | | | |
|---|---|---|---|
| CN | 105564050 | A | 5/2016 |
| EP | 2 634 003 | A1 | 9/2013 |
| EP | 3 017 956 | A1 | 5/2016 |
| JP | 05-280936 | A | 10/1993 |
| JP | 06-115752 | A | 4/1994 |
| JP | 09-020002 | A | 1/1997 |
| JP | 2006-091384 | A | 4/2006 |
| JP | 2007-33537 | A | 2/2007 |
| JP | 2012-006349 | A | 1/2012 |
| JP | 2012-194361 | A | 10/2012 |
| JP | 2013-125011 | A | 6/2013 |
| JP | 2013-136245 | A | 7/2013 |
| JP | 2016-055570 | A | 4/2016 |
| JP | 2016-087798 | A | 5/2016 |
| JP | 2016-088654 | A | 5/2016 |
| JP | 2017-067823 | A | 4/2017 |
| JP | 2019-042969 | A | 3/2019 |

OTHER PUBLICATIONS

Chinese Office Action issued in corresponding Chinese Patent Application No. 201810987641.9, dated Apr. 7, 2020, with English translation.

Extended European Search Report issued in corresponding European Patent Application No. 18189267.0-1019, dated Feb. 22, 2019.

U.S. PTO Non-Final Office Action issued in related parent U.S. Appl. No. 16/107,417, dated Nov. 13, 2019.

U.S. PTO Notice of Allowance issued in related parent U.S. Appl. No. 16/107,417, dated Apr. 28, 2020.

Related parent U.S. Appl. No. 16/107,417, filed Aug. 21, 2018.

Japanese Decision to Grant a Patent issued in corresponding Japanese Patent Application No. 2017-183299, dated May 25, 2021, with English translation.

BASE MATERIAL PROCESSING APPARATUS AND DETECTION METHOD

RELATED APPLICATIONS

This application is a Divisional of U.S. patent application Ser. No. 16/107,417, filed on Aug. 21, 2018, which claims the benefit of Japanese Application No. 2017-183299, filed on Sep. 25, 2017, the disclosure of which is incorporated by reference herein.

BACKGROUND OF THE INVENTION

Field of the Invention

The present invention relates to a technique for use in a base material processing apparatus that processes a long band-like base material while transporting the base material and for detecting the amount of displacement in the position of the base material in the transport direction.

Description of the Background Art

Inkjet image recording apparatuses have conventionally been known, in which a multicolor image is recorded on long band-like printing paper by ejecting ink from a plurality of recording heads while transporting the printing paper in a longitudinal direction of the printing paper. In the image recording apparatuses, different color inks are ejected from the plurality of heads respectively, and then single-color images formed by the ejection of each color ink are superimposed one on another so that a multicolor image is recorded on a surface of the printing paper. Japanese Patent Application Laid-Open No. 2016-55570 discloses one example of such conventional image recording apparatuses.

This type of image recording apparatuses are designed to transport printing paper at a constant speed with use of a plurality of rollers. However, the ejection of ink to a surface of printing paper causes slight elongation of the printing paper. Then, due to this elongation of the printing paper, the transport speed of the printing paper under the recording heads may differ from an ideal transport speed. In this case, misregistration of single-color images relative to one another occurs because positions at which each color ink is to be ejected onto the surface of the printing paper become displaced in the transport direction.

In order to suppress such misregistration of single-color images relative to one another, reference images such as register marks have conventionally been formed on a surface of printing paper. The image recording apparatuses detect the positions of the reference images and correct the positions at which ink is to be ejected from each recording head, on the basis of the detection results. However, the reference images are formed at predetermined intervals in the transport direction of the printing paper. Thus, it is difficult to continuously detect displacements in the position of the printing paper on the basis of the reference images. Besides, the space for recording an intended print image is narrowed if the reference images are formed on the surface of the printing paper.

SUMMARY OF THE INVENTION

It is an object of the present invention to provide a technique for use in a base material processing apparatus that processes a long band-like base material while transporting the base material in a longitudinal direction, and for detecting the amount of displacement in the position of the base material in the transport direction without depending on images such as register marks formed on a surface of the base material.

To solve the problems described above, a first aspect of the present invention is a base material processing apparatus that includes a transport mechanism that transports a long band-like base material in a longitudinal direction along a predetermined transport path, a first detection part that acquires a first detection result by continuously or intermittently detecting a position of an edge of the base material in a width direction at a first detection position in the transport path, a second detection part that acquires a second detection result by continuously or intermittently detecting a position of the edge of the base material in the width direction at a second detection position that is located downstream of the first detection position in the transport path, and a displacement amount calculation part that calculates an amount of expansion and contraction of the base material in the width direction on the basis of the first detection result and the second detection result and calculates an amount of displacement in a position of the base material in a transport direction on the basis of a result that is obtained by multiplying a calculation result of the amount of expansion and contraction of the base material in the width direction by an aspect ratio that is a ratio between the amount of expansion and contraction of the base material in the width direction and an amount of expansion and contraction of the base material in the transport direction.

A second aspect of the present invention is a base material processing apparatus that includes a transport mechanism that transports a long band-like base material in a longitudinal direction along a predetermined transport path, a first detection part that acquires a first detection result by continuously or intermittently detecting a position of an edge of the base material in a width direction at a first detection position in the transport path, a second detection part that acquires a second detection result by continuously or intermittently detecting a position of the edge of the base material in the width direction at a second detection position that is located downstream of the first detection position in the transport path, and a displacement amount calculation part that calculates an amount of expansion and contraction of the base material in the width direction on the basis of the first detection result and the second detection result and calculates an amount of displacement in a position of the base material in a transport direction on the basis of a result that is obtained by substituting a calculation result of the amount of expansion and contraction of the base material in the width direction into a matrix transformation that expresses a relationship between the amount of expansion and contraction of the base material in the width direction and an amount of expansion and contraction of the base material in the transport direction.

A third aspect of the present invention is a detection method of detecting an amount of displacement in a position of a long band-like base material in a transport direction while transporting the base material in a longitudinal direction along a predetermined transport path. The detection method includes a) acquiring a first detection result by continuously or intermittently detecting a position of an edge of the base material in a width direction at a first detection position in the transport path, b) acquiring a second detection result by continuously or intermittently detecting a position of the edge of the base material in the width direction at a second detection position that is located downstream of the first detection position in the transport path, c) calculating an amount of expansion and contraction of the base material in the width direction on the basis of the first detection result and the second detection result, and d) calculating the amount of displacement in the position of the base material in the transport direction on the basis of a result that is obtained by multiplying a calculation result of the amount of expansion and contraction of the base material in the width direction by an aspect ratio that is a ratio between the amount of expansion and contraction of the base material in the width direction and an amount of expansion and contraction of the base material in the transport direction.

A fourth aspect of the present invention is a detection method of detecting an amount of displacement in a position of a long band-like base material in a transport direction while transporting the base material in a longitudinal direction along a predetermined transport path. The detection method includes a) acquiring a first detection result by continuously or intermittently detecting a position of an edge of the base material in a width direction at a first detection position in the transport path, b) acquiring a second detection result by continuously or intermittently detecting a position of the edge of the base material in the width direction at a second detection position that is located downstream of the first detection position in the transport path, c) calculating an amount of expansion and contraction of the base material in the width direction on the basis of the first detection result and the second detection result, and d) calculating the amount of displacement in the position of the base material in the transport direction on the basis of a result that is obtained by substituting a calculation result of the amount of expansion and contraction of the base material in the width direction into a matrix transformation that expresses a relationship between the amount of expansion and contraction of the base material in the width direction and an amount of expansion and contraction of the base material in the transport direction.

According to the first to fourth aspects of the present invention, the amount of displacement in the position of the base material in the transport direction can be detected without depending on images such as register marks formed on a surface of the base material.

Also, according to the first to fourth aspects of the present invention, there is no need to separately provide a detection part for detecting the amount of displacement in the position of the base material in the width direction and a detection part for detecting the amount of displacement in the position of the base material in the transport direction. Thus, it is possible to reduce the number of components in the base material processing apparatus.

These and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, one embodiment of the present invention will be described with reference to the drawings.

1. Configuration of Image Recording Apparatus

Figure 1:
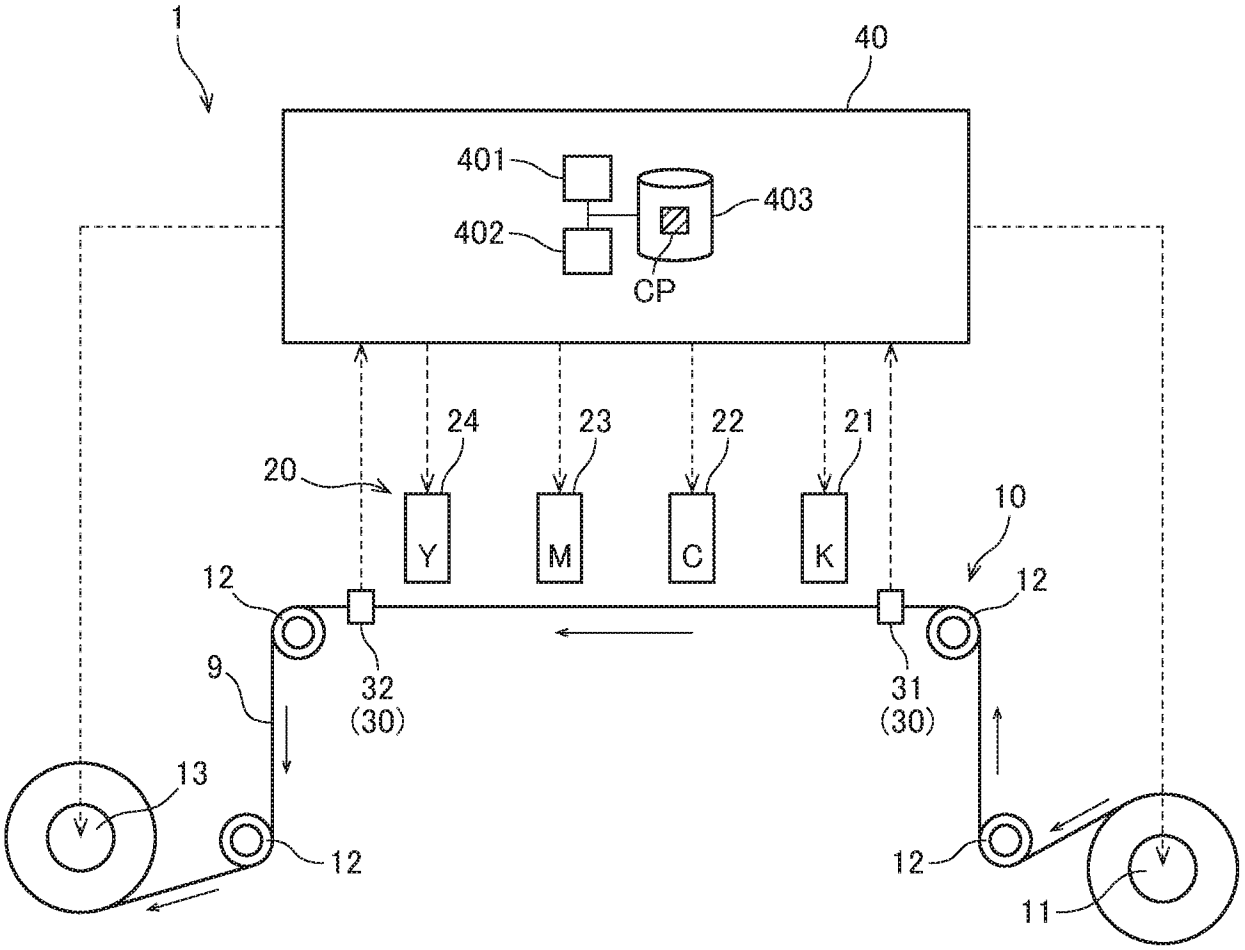
FIG. 1 illustrates a configuration of an image recording apparatus according to an embodiment.

FIG. 1 illustrates a configuration of an image recording apparatus 1 as one example of a base material processing apparatus according to the present invention. The image recording apparatus 1 is an inkjet printing apparatus that records a multicolor image on printing paper 9, which is a long band-like base material, by ejecting ink toward the printing paper 9 from a plurality of recording heads 21 to 24 while transportingtheprintingpaper 9. As illustrated in FIG. 1, the image recording apparatus 1 includes a transport mechanism 10, an image recording part 20, two edge sensors 30, and a controller 40.

The transport mechanism 10 is a mechanism for transporting the printing paper 9 in a transport direction that is along the longitudinal direction of the printing paper 9. The transport mechanism 10 according to the present embodiment includes a plurality of rollers that include a feed roller 11, a plurality of transport rollers 12, and a take-up roller 13. The printing paper 9 is fed from the feed roller 11 and transported along a predetermined transport path constructed by the plurality of transport rollers 12. Each transport roller 12 rotates about a horizontal axis so as to guide the printing paper 9 downstream of the transport path. The transported printing paper 9 is collected by the take-up roller 13. Among these plurality of rollers, at least some rollers are rotationally driven by a drive part 45 of the controller 40, which will be described later.

As illustrated in FIG. 1, the printing paper 9 travels in approximately parallel with the direction of arrangement of the plurality of recording heads 21 to 24 under the recording heads 21 to 24. At this time, the record surface of the printing paper 9 faces upward (i.e., faces the recording heads 21 to 24). The printing paper 9 runs under tension over the plurality of transport rollers 12. This configuration suppresses the occurrence of slack or creases in the printing paper 9 during transport.

The image recording part 20 is a processing part that ejects ink droplets to the upper surface (front surface) of the printing paper 9, which is being transported by the transport mechanism 10, at processing positions in the transport path. The image recording part 20 according to the present embodiment includes the first recording head 21, the second recording head 22, the third recording head 23, and the fourth recording head 24. The first recording head 21, the second recording head 22, the third recording head 23, and the fourth recording head 24 are arranged along the transport path of the printing paper 9.

Figure 2:
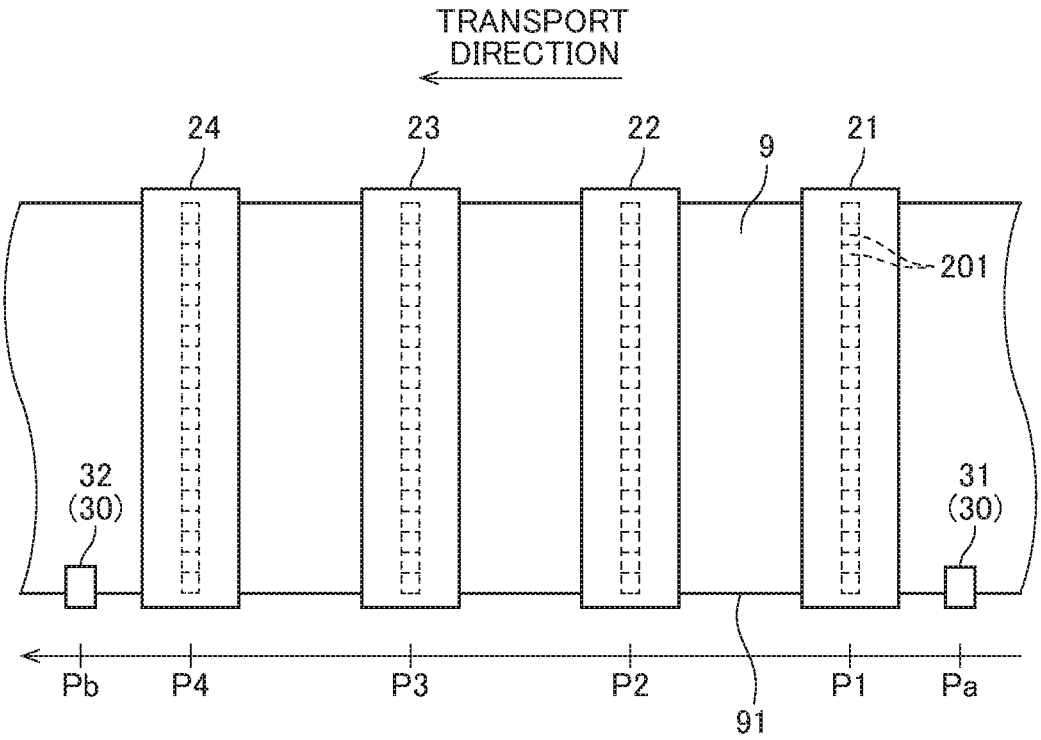
FIG. 2 is a partial top view of the image recording apparatus in the proximity of an image recording part according to the embodiment.

FIG. 2 is a partial top view of the image recording apparatus 1 in the proximity of the image recording part 20. The four recording heads 21 to 24 each cover the entire width of the printing paper 9. Each of the recording heads 21 to 24 has a lower surface having a plurality of nozzles 201 aligned in parallel with the width direction of the printing paper 9 as indicated by the broken lines in FIG. 2. The recording heads 21 to 24 respectively eject black (K), cyan (C), magenta (M), and yellow (Y) ink droplets, which are color components of a multicolor image, from their plurality of nozzles 201 toward the upper surface of the printing paper 9.

That is, the first recording head 21 ejects black ink droplets to the upper surface of the printing paper 9 at a first processing position P1 in the transport path. The second recording head 22 ejects cyan ink droplets to the upper surface of the printing paper 9 at a second processing position P2 that is located downstream of the first processing position P1. The third recording head 23 ejects magenta ink droplets to the upper surface of the printing paper 9 at a third processing position P3 that is located downstream of the second processing position P2. The fourth recording head 24 ejects yellow ink droplets to the upper surface of the printing paper 9 at a fourth processing position P4 that is located downstream of the third processing position P3. In the present embodiment, the first processing position P1, the second processing position P2, the third processing position P3, and the fourth processing position P4 are aligned at equal intervals in the transport direction of the printing paper 9.

The four recording heads 21 to 24 each record a single-color image on the upper surface of the printing paper 9 by ejecting ink droplets. The four single-color images are then superimposed one on another so that a multicolor image is formed on the upper surface of the printing paper 9. Therefore, if the positions in the transport direction of ink droplets ejected from the four recording heads 21 to 24 on the printing paper 9 are displaced from one another, the image quality of printed material deteriorates. Thus, it becomes an important factor to control such misregistration of single-color images relative to one another on the printing paper 9 to within tolerance in order to improve the print quality of the image recording apparatus 1.

Note that a dry processing part for drying ink ejected to the record surface of the printingpaper 9 may be additionally provided on the downstream side of the recording heads 21 to 24 in the transport direction. The dry processing part dries the ink by, for example, blowing heated gas toward the printing paper 9 and vaporizing a solvent in the ink adhering to the printing paper 9. The dry processing part may, however, use other methods such as photoirradiation to dry the ink.

The two edge sensors 30 serve as detection parts that detect the positions of an edge (edge in the width direction) 91 of the printing paper 9 in the width direction. In the present embodiment, the edge sensors 30 are disposed at a first detection position Pa that is located upstream of the first processing position P1 in the transport path and at a second detection position Pb that is located downstream of the fourth processing position P4.

Figure 3:
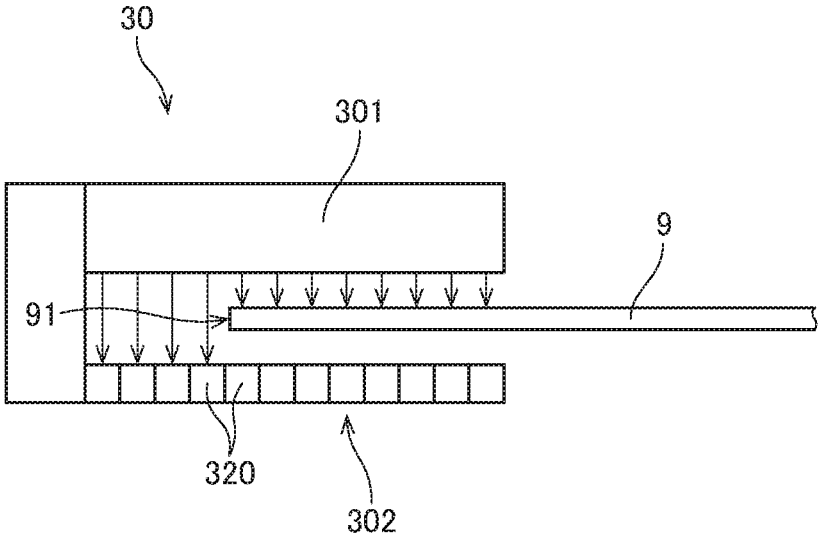
FIG. 3 schematically illustrates a structure of an edge sensor according to the embodiment.

FIG. 3 schematically illustrates the structure of one edge sensor 30. As illustrated in FIG. 3, the edge sensor 30 includes a projector 301 that is located above the edge 91 of the printing paper 9, and a line sensor 302 that is located below the edge 91. The projector 301 emits parallel light downward. The line sensor 302 includes a plurality of light receiving elements 320 aligned in the width direction. Outside the edge 91 of the printing paper 9, the light emitted from the projector 301 enters the light receiving elements 320, and the light receiving elements 320 detect the light as illustrated in FIG. 3. Inside the edge 91 of the printing paper 9, on the other hand, the light emitted from the projector 301 is blocked by the printing paper 9, and therefore the light receiving elements 320 do not detect the light. The edge sensor 30 detects the position of the edge 91 of the printing paper 9 in the width direction on the basis of whether the light is detected or not by the plurality of light receiving elements 320.

As illustrated in FIGS. 1 and 2, the edge sensor 30 that is disposed at the first detection position Pa is hereinafter referred to as a "first edge sensor 31." The edge sensor 30 that is disposed at the second detection position Pb is referred to as a "second edge sensor 32." The first edge sensor 31 is one example of a "first detection part" according to the present invention. The first edge sensor 31 intermittently detects the position of the edge 91 of the printingpaper 9 in the width direction at the first detection position Pa. Thus, the first edge sensor 31 acquires a detection result that indicates a change over time in the position of the edge 91 in the width direction at the first detection position Pa. The first edge sensor 31 then outputs a detection signal indicating the obtained detection result to the controller 40. The second edge sensor 32 is one example of a "second detection part" according to the present invention. The second edge sensor 32 intermittently detects the position of the edge 91 of the printing paper 9 in the width direction at the second detection position Pb. Thus, the second edge sensor 32 acquires a detection result that indicates a change over time in the position of the edge 91 in the width direction at the second detection position Pb. The second edge sensor 32 then outputs a detection signal indicating the obtained detection result to the controller 40.

The controller 40 controls operations of each component in the image recording apparatus 1. As illustrated schematically in FIG. 1, the controller 40 is configured by a computer that includes a processor 401 such as a CPU, a memory 402 such as a RAM, and a storage 403 such as a hard disk drive. The storage 403 stores a computer program CP for executing print processing. As indicated by the broken lines in FIG. 1, the controller 40 is electrically connected to each of the transport mechanism 10, the four recording heads 21 to 24, and the two edge sensors 30, which are described above. The controller 40 controls operations of these components in accordance with the computer program CP. In this way, print processing progresses in the image recording apparatus 1.

2. Detection and Correction Processing

In the case of executing print processing, the controller 40 acquires detection signals from the first edge sensor 31 and the second edge sensor 32. Then, on the basis of the acquired detection signals, the controller 40 detects the amount of displacement in the position of the printing paper 9 in the transport direction. The controller 40 also corrects the timing of ejection of ink droplets from the four recording heads 21 to 24 on the basis of the detected amount of displacement in position. This suppresses the aforementioned misregistration of single-color images relative to one another.

Figure 4:
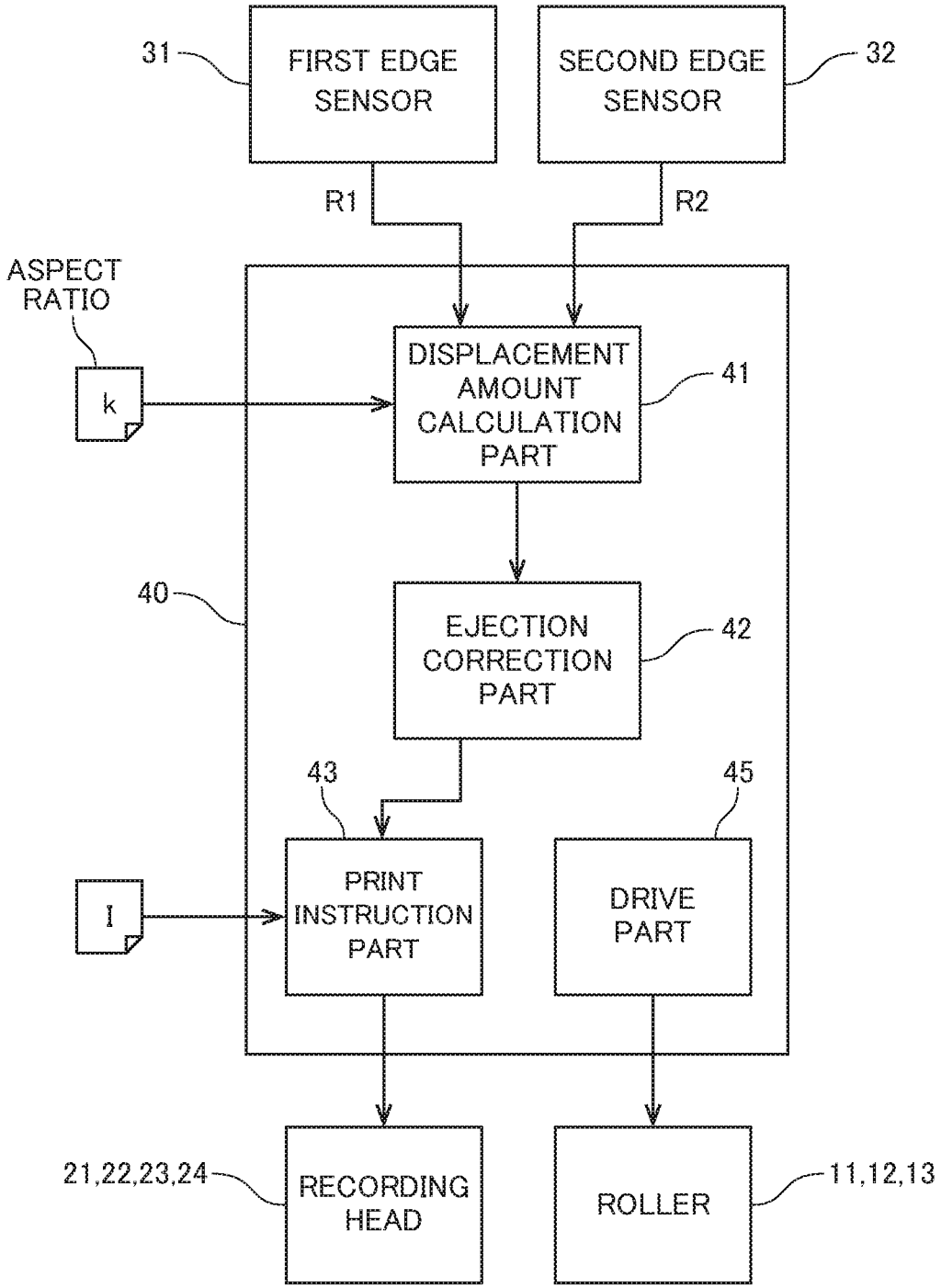
FIG. 4 is a block diagram schematically illustrating functions of a controller according to the embodiment.

FIG. 4 is a block diagram schematically illustrating functions of the controller 40 for implementing the detection and correction processing. As illustrated in FIG. 4, the controller 40 includes a displacement amount calculation part 41, an ejection correction part 42, a print instruction part 43, and the drive part 45. The functions of the displacement amount calculation part 41, the ejection correction part 42, the print instruction part 43, and the drive part 45 are implemented by the processor 401 operating in accordance with the computer program CP. Note that the drive part 45 transports the printing paper 9 along the transport path by rotationally driving at least one of the plurality of rollers including the feed roller 11, the plurality of transport rollers 12, and the take-up roller 13 at a constant rotation speed. Note that the controller 40 may include a memory that temporarily stores the first detection result R1 and the second detection result R2 that are transmitted respectively from the first edge sensor 31 and the second edge sensor 32 to the displacement amount calculation part 41, which will be described below.

Figure 5A:
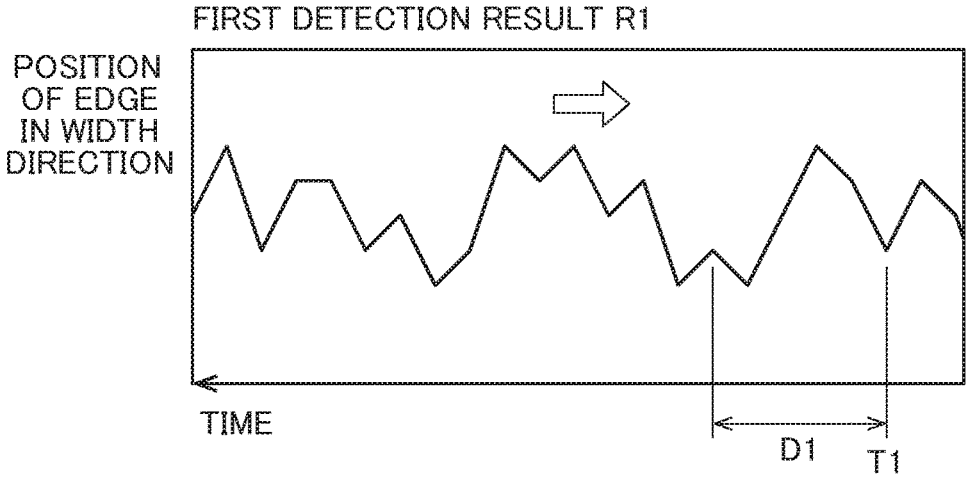
FIG. 5A is a graph showing an example of a first detection result according to the embodiment.
Figure 5B:
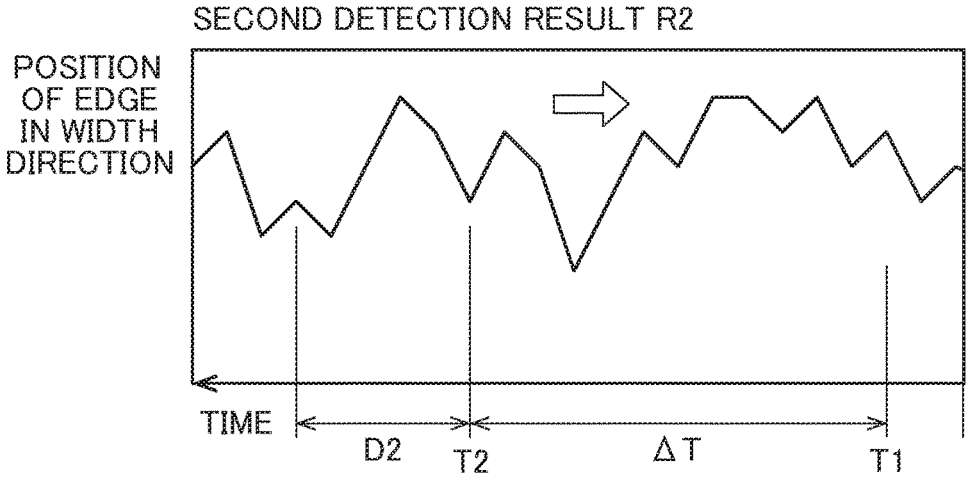
FIG. 5B is a graph showing an example of a second detection result according to the embodiment.

The displacement amount calculation part 41 detects the amount of displacement in the position of the printing paper 9 in the transport direction on the basis of the first detection result R1 obtained from the first edge sensor 31 and the second detection result R2 obtained from the second edge sensor 32. FIG. 5A is a graph showing an example of the first detection result R1. FIG. 5B is a graph showing an example of the second detection result R2. In the graphs in FIGS. 5A and 5B, the horizontal axis represents time, and the vertical axis represents the position of the edge 91 in the width direction. Note that in the graphs in FIGS. 5A and 5B, the left end of the horizontal axis is the current time, and time passes from right to left. Thus, the data lines in FIGS. 5A and 5B move to the right with the passage of time as indicated by hollow arrows. Accordingly, for example, the value at the right end of the data line in FIG. 5A indicates the position in the width direction of the edge 91 of a portion of the printing paper 9 that has passed through the first edge sensor 31 at the earliest time in the data line in FIG. 5A. Also, the value at the right end of the data line in FIG. 5B indicates the position in the width direction of the edge 91 of a portion of the printing paper 9 that has passed through the second edge sensor 32 at the earliest time in the data line in FIG. 5B.

There are fine irregularities at the edge 91 of the printing paper 9. The first edge sensor 31 and the second edge sensor 32 detect the positions of the edge 91 of the printing paper 9 in the width direction at pre-set very short time intervals. Accordingly, data that indicates a change over time in the position of the edge 91 of the printing paper 9 in the width direction is obtained as illustrated in FIGS. 5A and 5B. The first detection result R1 illustrated in FIG. 5A is data that reflects the shape of the edge 91 of the printing paper 9 passing through the first detection position Pa. The second detection result R2 illustrated in FIG. 5B is data that reflects the shape of the edge 91 of the printing paper 9 passing through the second detection position Pb.

The displacement amount calculation part 41 compares the first detection result R1 and the second detection result R2 and then identifies a point where the same edge 91 of the printing paper 9 has been detected from the first detection result R1 and the second detection result R2. Specifically, the displacement amount calculate part 41 identifies a highly matched data section included in the second detection result R2 for each data section (a given range of time) included in the first detection result R1. Hereinafter, data sections included in the first detection result R1 are referred to as "comparison source data sections D1," and data sections included in the second detection result R2 are referred to as "to-be-compared data sections D2."

For the identification of data sections, for example, a matching technique such as cross-correlation or residual sum of squares is used. The displacement amount calculation part 41 selects a plurality of to-be-compared data sections D2 included in the second detection result R2 for each comparison source data section D1 included in the first detection result R1, as candidates for the corresponding data section. The displacement amount calculation part 41 also calculates an evaluation value for each of the selected to-be-compared data sections D2, the evaluation value indicating the degree of matching with the comparison source data section D1. Then, the to-be-compared data section D2 having a highest evaluation value is identified as a to-be-compared data section D2 that corresponds to the comparison source data section D1.

Note that a time difference between the first detection result R1 and the second detection result R2 does not differ considerably from an ideal transport time of the printing paper 9 from the first detection position Pa to the second detection position Pb. Thus, the aforementioned search for the to-be-compared data section D2 only needs to be conducted on data sections at around a time after the elapse of the ideal transport time from the detection of the comparison source data section D1. Once the to-be-compared data section D2 corresponding to the comparison source data section D1 has been identified, the next and subsequent searches only need to be conducted on data sections adjacent to the searched to-be-compared data section D2 and nearby data sections. Note that the "ideal transport time" as used herein refers to the amount of time required to transport the printing paper 9 from the first detection position Pa to the second detection position Pb when the printing paper has no elongation caused by ink. Also, the transport speed of the printing paper 9 in the case where the printing paper has no elongation caused by ink is hereinafter referred to as an "ideal transport speed."

In this way, the displacement amount calculation part 41 may estimate a to-be-compared data section D2 of the second detection result R2 that corresponds to the comparison source data section D1 of the first detection result R1 and search only data sections in the proximity of the estimated data section for the to-be-compared data section D2 that highly matches the comparison source data section D1. This narrows down the range of search for the to-be-compared data section D2. Accordingly, it is possible to reduce arithmetic processing loads on the displacement amount calculation part 41.

Figure 5C:
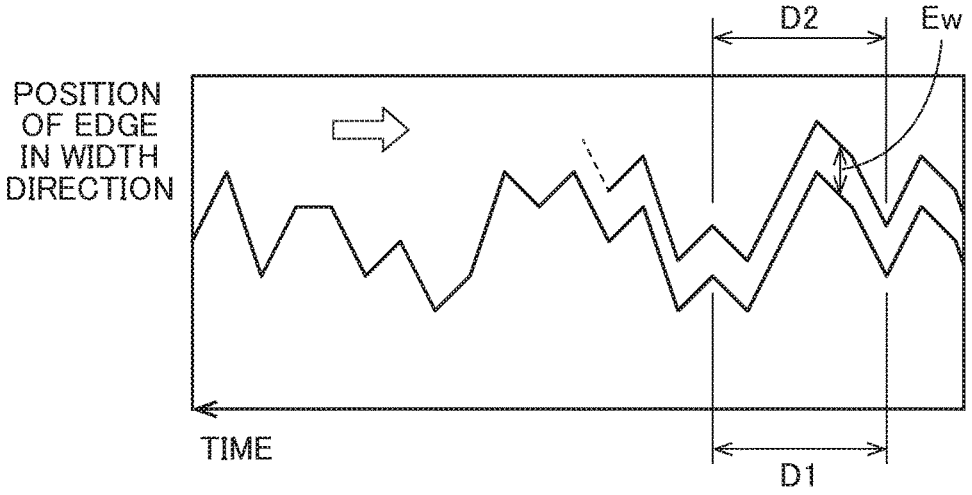
FIG. 5C is a graph obtained by overlaying the examples of the first detection result and the second detection result according to the embodiment.

Thereafter, the displacement amount calculation part 41 calculates an actual transport time ΔT required to transport the printing paper 9 from the first detection position Pa to the second detection position Pb on the basis of the time difference between the detection time of the comparison source data section D1 (time T1 in FIG. 5A) and the detection time of the corresponding to-be-compareddata section D2 (time T2 inFIG. 5B). The displacement amount calculation part 41 then compares the first detection result R1 and the second detection result R2 that is obtained after the elapse of the calculated transport time ΔT. FIG. 5C is a graph obtained by overlaying the example of the first detection result R1 and the example of the second detection result R2 obtained after the elapse of the transport time ΔT. In FIG. 5C, the graph showing the example of the second detection result R2 is moved in the pori zontal direction and overlaid and displayed on the graph showing the example of the first detection result R1 such that the detection time T2 of the data section D2 coincides with the detection time T1 of the data section D1.

At the same time, the displacement amount calculation part 41 calculates an actual transport speed of the printing paper 9 under the image recording part 20 from the calculated actual transport time ΔT required to transport the printing paper 9 from the first detection position Pa to the second detection position Pb. The actual transport speed can be calculated by dividing the distance from the first detection position Pa to the second detection position Pb by the transport time ΔT.

Refer back to FIG. 5C. Next, the displacement amount calculation part 41 compares the data section D1 of the first detection result R1 and the data section D2 of the second detection result R2 that are overlaid. A difference in the position of the edge 91 in the width direction between the data section D2 and the data section D1 indicates the amount of change (amount of expansion and contraction) caused by ink ejection in the position in the width direction of the edge 91 of the printing paper 9 transported from the first detection position Pa to the second detection position Pb. That is, as described above, the amount of expansion and contraction Ew of the printing paper 9 in the width direction can be calculated on the basis of the result of comparison between the first detection result R1 and the second detection result R2 obtained after the elapse of the time ΔT required to transport the printing paper 9 from the first detection position Pa to the second detection position Pb. Note that, in the case of calculating the difference in the position of the edge 91 in the width direction between the data section D2 and the data section D1, for example, a difference between average values of those sections may be calculated. The calculation method is, however, not limited to this example.

Moreover, in the case of comparing the data section D1 of the first detection result R1 and the data section D2 of the second detection result R2 that are overlaid, the displacement amount calculation part 41 may compare filtered data of the first detection result R1 and filtered data of the second detection result R2. That is, the displacement amount calculation part 41 may calculate the amount of expansion and contraction Ew of the printing paper 9 in the width direction on the basis of the result of comparison between signals within a predetermined frequency band extracted from the first detection result R1 and signals within a predetermined frequency band extracted from the second detection result R2 obtained after the elapse of the actual transport time ΔT required to transport the printing paper 9 from the first detection position Pa to the second detection position Pb. In this case, errors caused by fine irregularities in the edge 91 of the printing paper 9 can be further reduced.

Figure 6:
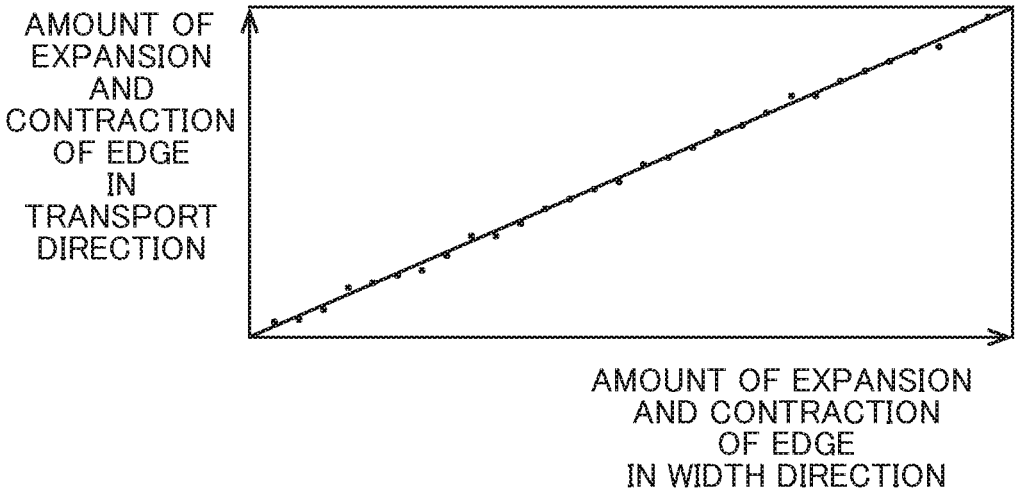
FIG. 6 is a graph showing a relationship between the amount of expansion and contraction of printing paper in the width direction and the amount of expansion and contraction of the printing paper in the transport direction according to the embodiment.

Next, the displacement amount calculation part 41 calculates the amount of displacement in the position of the printing paper 9 in the transport direction on the basis of a result that is obtained by multiplying the calculation result of the amount of expansion and contraction Ew of the printing paper 9 in the width direction by an "aspect ratio k." Here, the "aspect ratio k" will be described. The "aspect ratio k" as used herein refers to a ratio between the amount of expansion and contraction Ew of the printing paper 9 in the width direction and the amount of expansion and contraction El of the printing paper 9 in the transport direction, and also refers to a coefficient inherent in the material for the printing paper 9. FIG. 6 is a graph showing the relationship between the amount of expansion and contraction Ew of the printing paper 9 in the width direction and the amount of expansion and contraction El of the printing paper 9 in the transport direction. In FIG. 6, dots indicate the results of measurement of the amount of expansion and contraction Ew of the printing paper 9 in the width direction and the amount of expansion and contraction El of the printing paper 9 in the transport direction (extension direction), obtained by ejecting ink to the surface of the long band-like printing paper 9 a plurality of times while changing the amount of the ink inside or outside the image recording apparatus 1. As illustrated in FIG. 6, the amount of expansion and contraction El of the printing paper 9 in the transport direction can be approximated by a linear expression that is obtained by multiplying the amount of expansion and contraction Ew of the printing paper 9 in the width direction by a coefficient. Then, the coefficient of the linear expression that represents the obtained relationship between the amount of expansion and contraction Ew of the printing paper 9 in the width direction and the amount of expansion and contraction El of the printing paper 9 in the transport direction is recognized as the "aspect ratio k" and stored in the controller 40.

After having calculated the amount of expansion and contraction El of the printing paper 9 in the transport direction between the first detection position Pa and the second detection position Pb, the displacement amount calculation part 41 calculates the amount of displacement in the position of the printing paper 9 in the transport direction at the first processing position P1, the second processing position P2, the third processing position P3, and the fourth processing position P4, in contrast to the case that the printing paper is transported at the ideal transport speed. The amounts of displacement in position in the transport direction at the first processing position P1, the second processing position P2, the third processing position P3, and the fourth processing position P4 are calculated by, for example, allocating (dividing) the amount of expansion and contraction El in the transport direction in accordance with the positional relationship of the processing positions P1 to P4, the first detection position Pa, and the second detection position Pb. For example, in the case where six positions in total, namely the four processing positions P1 to P4 and the two detection positions Pa and Pb, are aligned at equal intervals, it can be interpreted that the printing paper 9 at the fourth processing position P4, which is closest to the second detection position Pb, is elongated in the transport direction by the amount obtained by multiplying the amount of expansion and contraction El between the first detection position Pa and the second detection position Pb by four fifth. That is, the amount of displacement in position at the fourth processing position P4 can be calculated as a four fifth of the amount of expansion and contraction El.

Note that this example does not limit the method of calculating the amount of displacement in the position of the printing paper 9 in the transport direction at each of the processing positions P1 to P4 from the amount of expansion and contraction El of the printing paper 9 in the transport direction between the first detection position Pa and the second detection position Pb. For example, in the case where the first detection position Pa is located considerably close to the first processing position P1, the amount of displacement in position at the first processing position P1 may be interpreted as the same as the amount of expansion and contraction El.

In this way, the image recording apparatus 1 according to the present embodiment detects the shape of the edge 91 of the printing paper 9 at the two positions, namely the first detection position Pa and the second detection position Pb, and calculates the amount of displacement in the position of the printingpaper 9 in the transport direction on the basis of the detection results. Thus, it is possible to detect the amount of displacement in the position of the printing paper 9 in the transport direction without depending on images such as register marks formed on the surface of the printing paper 9.

In particular, according to the present embodiment, the ejection of ink droplets to the record surface of the printing paper 9 occurs between the first detection position Pa and the second detection position Pb. Thus, even if the printing paper 9 is locally elongated in the transport direction due to the adhesion of ink, the amount of displacement in position in the transport direction caused by this elongation can be obtained from the results of detection at the first detection position Pa and the second detection position Pb.

Refer back to FIG. 4. The ejection correction part 42 corrects the timing of ejection of ink droplets from each of the recording heads 21 to 24 on the basis of the amount of displacement in position calculated by the displacement amount calculation part 41. For example, in the case where the elongation of the printing paper 9 has caused displacements in position at the processing positions P1 to P4, i.e., in the case where a portion of the printing paper 9 where an image is to be recorded arrives behind the ideal time at each of the processing positions P1 to P4, the ejection correction part 42 delays the timing of ejection of ink droplets from each of the recording heads 21 to 24. Also, in the case where a portion of the printing paper 9 where an image is to be recorded arrives earlier than the ideal time at each of the processing positions P1 to P4, the ejection correction part 42 advances the timing of ejection of ink droplets from each of the recording heads 21 to 24. Note that the amount of correction by which the timing of ejection of ink droplets is corrected may be calculated by, for example, dividing the amount of displacement in the position of the printing paper 9 at each of the processing positions P1 to P4 by the actual transport speed of the printing paper 9.

The print instruction part 43 controls the operation of ejecting ink droplets from each of the recording heads 21 to 24 on the basis of received image data I. At this time, the print instruction part 43 references the amount of correction of the ejection timing that is output from the ejection correction part 42. Then, the print instruction part 43 shifts the original ejection timing based on the image data I on the basis of the amount of correction. Thus, at each of the processing positions P1 to P4, ink droplets of each color are ejected at appropriate locations in the transport direction on the printing paper 9. This suppresses misregistration of single-color images of each color ink relative to one another. As a result, it is possible to obtain a high-quality print image with less misregistration of single-color images relative to one another.

3. Variations

Although an exemplary embodiment of the present invention has been described thus far, the present invention is not intended to be limited to the embodiment described above.

In the above-described embodiment, the ejection correction part 42 corrects the timing of ejection of ink droplets from each of the recording heads 21 to 24 on the basis of the amount of displacement in position calculated by the displacement amount calculation part 41. However, instead of correcting the timing of ejection of ink droplets, a transport correction part may be additionally provided to correct the amount of displacement in the position of the printing paper 9 in the transport direction by correcting a drive of at least one of the plurality of rollers on the basis of the amount of displacement in position calculated by the displacement amount calculation part 41. For example, in the case where the elongation of the printing paper 9 causes displacements in position at each of the processing positions P1 to P4, the transport correction part adjusts the number of rotations of the rollers so as to change the transport speed of the printing paper 9. In this way, correction is made such that ink droplets of each color are ejected to appropriate locations in the transport direction on the printing paper 9.

In the above-described embodiment, the ejection correction part 42 corrects the timing of ejection of ink droplets from the recording heads 21 to 24 without correcting the received image data I itself. Alternatively, the ejection correction part 42 may correct the image data I on the basis of the amount of displacement in position calculated by the displacement amount calculation part 41. In that case, the print instruction part 43 may instruct each of the recording heads 21 to 24 to eject ink droplets in accordance with the corrected image data I. As another alternative, the ejection correction part 42 may correct the position of ink ejection from each of the recording heads 21 to 24 on the basis of the amount of displacement in position calculated by the displacement amount calculation part 41. That is, the ejection correction part 42 only needs to correct either the timing or positions of ejection of ink droplets from the image recording part 20.

In the above-described embodiment, the amount of expansion and contraction El of the printing paper 9 in the transport direction is calculated on the basis of the result obtained by multiplying the calculation result of the amount of expansion and contraction Ew of the printing paper 9 in the width direction by the "aspect ratio k." Also, the "aspect ratio k" is regarded as the coefficient of the linear expression that expresses the relationship between the amount of expansion and contraction Ew of the printing paper 9 in the width direction and the amount of expansion and contraction E1 thereof in the transport direction. Alternatively, the relationship between the amount of expansion and contraction Ew of the printing paper 9 in the width direction and the amount of expansion and contraction El thereof in the transport direction may be expressed by a "multinomial expression (matrix transformation)." Then, the displacement amount calculation part 41 may calculate the amount of expansion and contraction El of the printingpaper 9 in the transport direction on the basis of a result obtained by substituting the calculation result of the amount of expansion and contraction Ew of the printing paper 9 in the width direction into this "matrix transformation" that expresses the relationship between the amount of expansion and contraction Ew of the printing paper 9 in the width direction and the amount of expansion and contraction El of the printing paper 9 in the transport direction.

In the above-described embodiment, the image recording apparatus 1 detects the position of the edge 91 of the printing paper 9 in the width direction at the two positions, namely the first detection position Pa and the second detection position Pb, and calculates the amount of displacement in the position of the printing paper 9 in the transport direction on the basis of the detection results. However, instead of providing the edge sensors 30 at the first detection position Pa and the second detection position Pb, edge sensors 30 may be provided respectively at positions under the recording heads 21 to 24 or at positions that are quite close to the positions under the recording heads 21 to 24. Then, these four edge sensors 30 may be used to calculate the amount of expansion and contraction Ew of the printing paper 9 in the width direction on the basis of the results of detection of the position of the edge 91 of the printing paper 9 in the width direction. This increases the accuracy of calculation of the amount of displacement in the position of the printing paper 9 in the transport direction at each of the recording heads 21 to 24.

In FIG. 2 described above, the nozzles 201 of each of the recording heads 21 to 24 are arranged in a line in the width direction. Alternatively, the nozzles 201 of each of the recording heads 21 to 24 may be arranged in two or more lines.

Figure 7:
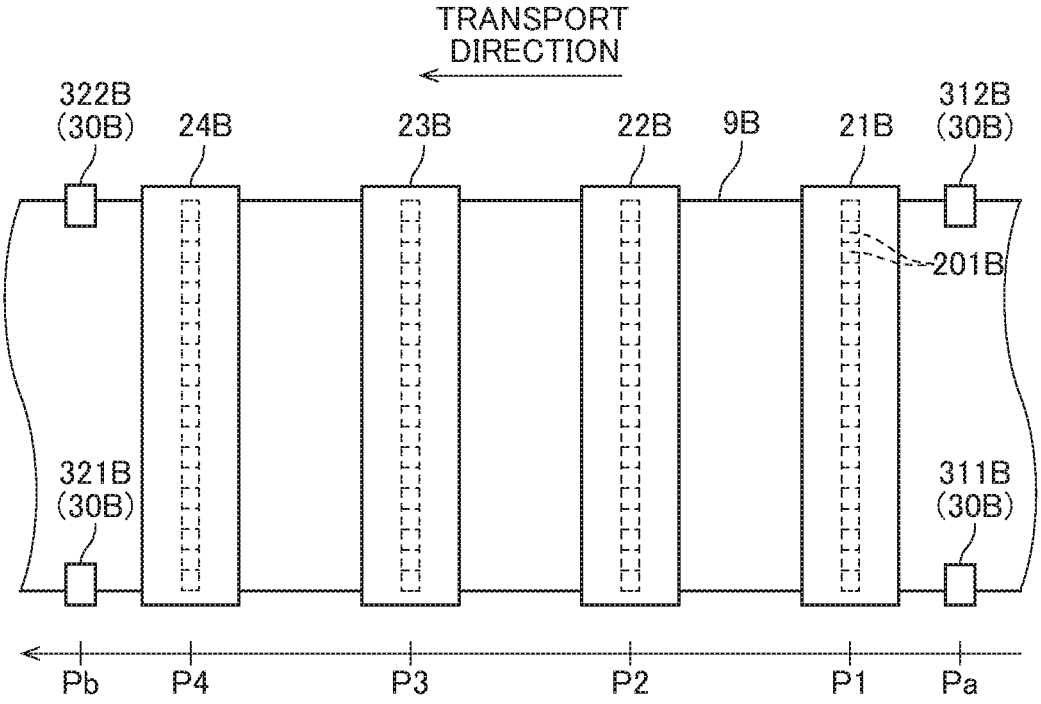
FIG. 7 is a partial top view of an image recording apparatus in the proximity of an image recording part according to a variation.

In the above-described embodiment, the image recording apparatus 1 detects the position of an edge of the printing paper 9 in the width direction on one side in the width direction by using the edge sensors 30 provided at each of the two positions, namely the first detection position Pa and the second detection position Pb, on only one edge side in the width direction of the printing paper 9. However, the image recording apparatus 1 may detect the positions of edges of the printing paper 9 in the width direction on both sides in the width direction by using edge sensors 30 that are provided at each of the two positions, namely the first detection position Pa and the second detection position P2, on both sides in the width direction of the printing paper 9. For example, as illustrated in FIG. 7, two first edge sensors 311B and 312B may be disposed at an interval in the width direction of printing paper 9B as "first detection parts," and two second edge sensors 321B and 322B may be disposed at an interval in the width direction of the printing paper 9B as "second detection parts." Then, the two first edge sensors 311B and 312B may intermittently detect the positions of the edges of the printing paper 9B in the width direction on both sides in the width direction at the first detection position Pa. Also, the two second edge sensors 321B and 322B may intermittently detect the positions of the edges of the printing paper 9B in the width direction on both sides in the width direction at the second detection position Pb.

This increases the accuracy of calculation of the amount of displacement in the position of the printing paper 9B in the transport direction at each of the recording heads 21B to 24B. For example, even if the amount of ink adhering to the printing paper 9B varies in the width direction and accordingly the amounts of displacement in the positions of the edges of the printing paper 9 in the width direction on both sides in the width direction differ from each other, this difference can be detected with use of the first edge sensors 311B and 312B and the second edge sensors 321B and 322B. As a result, the amount of expansion and contraction of the printing paper 9 in thewidthdirectionbetween the first detection position Pa and the second detection position Pb can be grasped with higher accuracy. Note that the way of disposing the edge sensors 30B is not limited to this example. For example, edge sensors 30B may be disposed on both sides in the width direction of the printing paper 9B at each of three positions in the transport path, namely the first detection position Pa located upstream of the first processing position P1, an intermediate detection position located between the second processing position P2 and the third processing position P3, and the second detection position Pb located downstream of the fourth processing position P4.

In the embodiment and variations described above, the location where the same edge 91 has been detected is identified by comparing the shape of the edge 91 of the printing paper 9 passing through the first detection position Pa and the shape of the edge 91 of the printing paper 9 passing through the second detection position Pb. Then, the amount of change in the position of the location in the width direction where the same edge 91 of the printing paper 9 has been detected (the amount of expansion and contraction in the width direction) is calculated. However, the location where the same edge 91 has been detected may be identified on the assumption that the printing paper 9 that has passed through the first detection position Pa passes through the second detection position Pb after the elapse of the aforementioned ideal transport time. That is, the amount of change in the position of the printing paper 9 in the width direction (the amount of expansion and contraction in the width direction) may be calculated from the position of the edge 91 of the printing paper 9 in the width direction detected at the first detection position Pa and the position of the edge 91 of the printing paper 9 in the width direction detected at the second detection position Pb after the elapse of the ideal transport time from the detection at the first detection position Pa.

Also, the amounts of displacement in position between the first processing position P1 and the second processing position P2, between the second processing position P2 and the third processing position P3, and between the third processing position P3 and the fourth processing position P4 may be calculated by, for example, linear interpolation using the first detection result R1 and the second detection result R2.

In the embodiment and variations described above, thru-beam type edge sensors are used as the first and second detection parts. However, other systems may be employed as a detection system used in the first and second detection parts. For example, reflective type optical sensors or CCD cameras may be used. The first and second detection parts may detect the positions of the edge of the printing paper two-dimensionally in both the transport direction and the width direction. The detection operations performed by the first and second detection parts may be conducted intermittently as in the above-described embodiment, or may be conducted continuously.

Moreover, the image recording apparatus may have a function of detecting and correcting meandering motion of the printing paper, a change in the obliqueness of the printing paper, the travelling position of the printing paper, or a change in the dimension of the printing paper in the width direction on the basis of the amount of displacement in the position of the printing paper in the width direction.

In the embodiment and variations described above, for example, a clock or a counter that is installed separately from the image recording apparatus may be used to measure the transport time of the printing paper or the time at each location. However, instead of using such a clock or a counter, time may be measured on the basis of signals received from rotary encoders that are connected to the rollers that are rotationally driven at a constant rotation speed in the transport mechanism.

In the embodiment and variations described above, the image recording apparatus includes four recording heads. However, the number of recording heads in the image recording apparatus may be in the range of one to three or may be five or more. For example, a recording head that ejects ink of a special color may be provided, in addition to the recording heads that eject ink of K, C, M, and Y colors. Moreover, these recording heads do not necessarily have to be disposed at equal intervals.

The present invention does not exclude the case of detecting the amount of displacement in the position of printing paper on the basis of reference images such as register marks formed on the surface of the printing paper. For example, the amount of displacement in the position of the printing paper in the transport direction may be detected by using in combination detection results obtained using reference images such as register marks and detection results of edges obtained using edge sensors as described above.

Although the image recording apparatus described above records a multicolor image on printing paper by inkjet printing, the base material processing apparatus according to the present invention may be an apparatus that uses a method other than inkjet printing (e.g., electrophotography or exposure) to record a multicolor image on printing paper. Although the image recording apparatus described above performs print processing on printing paper that is a base material, the base material processing apparatus according to the present invention may perform predetermined processing on a long band-like base member (e.g., resin film or gold foil) other than ordinary paper.

Each component described in the embodiment and variations described above may be combined appropriately within a range that causes no contradictions.

While the invention has been shown and described in detail, the foregoing description is in all aspects illustrative and not restrictive. It is therefore to be understood that numerous modifications and variations can be devised without departing from the scope of the invention.

What is claimed is:

1. A base material processing apparatus comprising:

a transport mechanism that transports a long band-like base material in a longitudinal direction along a predetermined transport path;

a first detection part that acquires a first detection result by continuously or intermittently detecting a position of an edge of the base material in a width direction at a first detection position in said transport path;

a second detection part that acquires a second detection result by continuously or intermittently detecting a position of the edge of the base material in the width direction at a second detection position that is located downstream of said first detection position in said transport path; and a displacement amount calculation part that calculates an amount of expansion and contraction of the base material in the width direction on the basis of said first detection result and said second detection result and calculates an amount of displacement in a position of the base material in a transport direction on the basis of a result that is obtained by substituting a calculation result of the amount of expansion and contraction of said base material in the width direction into a matrix transformation that expresses a relationship between the amount of expansion and contraction of the base material in the width direction and an amount of expansion and contraction of the base material in the transport direction.

2. The base material processing apparatus according to claim 1, wherein said displacement amount calculation part calculates the amount of expansion and contraction of the base material in the width direction on the basis of a result of comparison between said first detection result and said second detection result that is obtained after elapse of a time ΔT required to transport the base material from said first detection position to said second detection position.

3. The base material processing apparatus according to claim 2, wherein said displacement amount calculation part calculates the amount of expansion and contraction of the base material in the width direction on the basis of a result of comparison between a signal within a predetermined frequency band extracted from said first detection result and a signal within a predetermined frequency band extracted from said second detection result that is obtained after elapse of a time ΔT required to transport the base material from said first detection position to said second detection position.

4. The base material processing apparatus according to claim 1, further comprising:

a processing part that processes a base material at a processing position in said transport path, wherein said displacement amount calculation part calculates the amount of displacement in the position of the base material in the transport direction at said processing position.

5. The base material processing apparatus according to claim 4, wherein said processing part is an image recording part that records an image by ejecting ink to a surface of the base material.

6. The base material processing apparatus according to claim 5, wherein said processing part ejects ink to the surface of the base material at a position between said first detection position and said second detection position.

7. The base material processing apparatus according to claim 5, further comprising:

an ejection correction part that corrects a timing of ink ejection or a position of ink ejection from said image recording part on the basis of said amount of displacement in position calculated by said displacement amount calculation part.

8. The base material processing apparatus according to claim 7, wherein said image recording part includes a plurality of recording heads arranged in said transport direction, and said plurality of recording heads eject ink of different colors.

9. The base material processing apparatus according to claim 1, wherein said transport mechanism includes a plurality of rollers, the base material processing apparatus further comprising:

a drive part that rotationally drives at least one of said plurality of rollers; and a transport correction part that corrects the amount of displacement in the position of the base material in the transport direction by correcting a drive of at least one of said plurality of rollers on the basis of said amount of displacement in position calculated by said displacement amount calculation part.

10. The base material processing apparatus according to claim 1, wherein said first detection part includes two first sensors arranged at an interval in the width direction of the base material, said two first sensors continuously or intermittently detect positions of edges of the base material in the width direction on both sides in the width direction, said second detection part includes two second sensors arranged at an interval in the width direction of the base material, and said two second sensors continuously or intermittently detect positions of the edges of the base material in the width direction on the both sides in the width direction.

11. A detection method of detecting an amount of displacement in a position of a long band-like base material in a transport direction while transporting the base material in a longitudinal direction along a predetermined transport path, the detection method comprising:

a) acquiring a first detection result by continuously or intermittently detecting a position of an edge of the base material in a width direction at a first detection position in said transport path;

b) acquiring a second detection result by continuously or intermittently detecting a position of the edge of the base material in the width direction at a second detection position that is located downstream of said first detection position in said transport path;

c) calculating an amount of expansion and contraction of the base material in the width direction on the basis of said first detection result and said second detection result; and d) calculating the amount of displacement in the position of the base material in the transport direction on the basis of a result that is obtained by substituting a calculation result of the amount of expansion and contraction of the base material in the width direction into a matrix transformation that expresses a relationship between the amount of expansion and contraction of the base material in the width direction and an amount of expansion and contraction of the base material in the transport direction.

12. The detection method according to claim 11, wherein in said operation c), the amount of expansion and contraction of the base material in the width direction is calculated on the basis of a result of comparison between said first detection result and said second detection result that is obtained after elapse of a time ΔT required to transport the base material from said first detection position to said second detection position.

13. The detection method according to claim 12, wherein in said operation c), the amount of expansion and contraction of the base material in the width direction is calculated on the basis of a result of comparison between a signal within a predetermined frequency band extracted from said first detection result and a signal within a predetermined frequency band extracted from said second detection result that is obtained after elapse of a time ΔT required to transport the base material from said first detection position to said second detection position.

14. The detection method according to claim 11, further comprising:

e) recording an image by ejecting ink to a surface of the base material at a processing position in said transport path, wherein in said operation d), the amount of displacement in the position of the base material in the transport direction is calculated at said processing position.

15. The detection method according to claim 14, wherein in said operation e), ink is ejected to the surface of the base material at said processing position between said first detection position and said second detection position.

16. The detection method according to claim 14, wherein in said operation e), a timing of ink ejection or a position of ink ejection is corrected on the basis of the amount of displacement in the position of the base material in the transport direction at said processing position calculated in said operation d).

* * * * *